United States Patent [19]

Mohla et al.

[11] 4,037,643

[45] July 26, 1977

[54] NODULARIZING TREATMENT EMPLOYING UNITIZED MODIFYING AGENT

[75] Inventors: Prem P. Mohla, Plymouth; Adolf Hetke, Livonia; Robert J. Warrick, Ann Arbor, all of Mich.

[73] Assignee: Ford Motor Company, Dearborn, Mich.

[21] Appl. No.: 606,909

[22] Filed: Aug. 22, 1975

[51] Int. Cl.[2] ..... B22D 27/20

[52] U.S. Cl. ..... 164/58; 164/349; 164/362; 164/363; 164/57

[58] Field of Search ..... 164/57, 349, 363, 362, 164/58

[56] References Cited

U.S. PATENT DOCUMENTS

| | | | |
|---|---|---|---|
| 3,658,115 | 4/1972 | Ryntz, Jr. et al. | 164/57 |
| 3,703,922 | 11/1972 | Dunks et al. | 164/57 |
| 3,851,700 | 12/1974 | McAfee et al. | 164/57 |

FOREIGN PATENT DOCUMENTS

| | | | |
|---|---|---|---|
| 1,132,055 | 10/1968 | United Kingdom | 164/57 |
| 1,132,056 | 10/1968 | United Kingdom | 164/57 |

OTHER PUBLICATIONS

"Production of Nodular Graphite Iron Castings by the 'Inmold' Process" by J. L. McCaulay; Foundry Trade Journal, dated 15th Apr. 1971.

*Primary Examiner*—Leonidas Vlachos
*Attorney, Agent, or Firm*—Joseph W. Malleck; Keith L. Zerschling

[57] ABSTRACT

A method and apparatus is disclosed for conditioning a charge of molten cast iron, which would normally solidify with a flake graphite structure, to produce partial or total spheroidal graphite cast iron. In addition, the method and apparatus can be used to further condition a partially conditioned cast iron to yield a partial or fully spheroidal graphite cast iron. A recess is provided in the metal flow system (within or without the mold system) leading to the casting cavity or cavities. The recess has a shape and cross-section (taken in directions normal to the direction of flow of the molten charge) such that the spheroidizing agent dissolves uniformly when the molten iron flows over it to achieve unprecedented homogeneity. A dense solid unitary block of spheroidizing or nodularizing agent, substantially devoid of MgO interiorly thereof, is typically snugly fitted in said recess and mates with the side walls and bottom of said recess. The block typically presents a substantially constant and uniform interface with the molten charge during all stages of conditioning and pouring; however, a deviation in the interface area may be designed into the block to compensate for molten iron temperature variations or molten iron flow rate variations when the casting technique experiences unusually high variations in the ferrostatic pressure head. A relationship is disclosed between charge weight, charge flow rate, magnesium concentration in the spheroidizing alloy, and interface area so as to determine a desired degree of nodularity in the final casting and/or to design a solution rate compatible with a specific casting technique. The residual magnesium can be reliably maintained at a level sufficient to consistently obtain full spheroidal graphite shape. A preferred magnesium level is 0.020% to 0.040% of the weight of the casting but higher or lower levels can be reliably obtained if required by base metal chemistry. This is significant since the prior art has been unable to reliably obtain full nodularity with 0.02–0.025% residual magnesium under commercial conditions.

22 Claims, 8 Drawing Figures

NODULARIZING TREATMENT EMPLOYING UNITIZED MODIFYING AGENT

BACKGROUND OF THE INVENTION

The ability to nodularize cast iron was significantly advanced some 27 years ago when it became known that magnesium, cerium, other rare earths, calcium or their alloys (hereinafter referred to as the alloy) will condition a molten cast iron to form nodular graphite upon solidification. Since that time, the art has moved progressively from (a) adding the alloy to the molten iron charge in the ladle by such methods as plunging, emersion or the sandwich technique, to (b) adding the alloy to the molten charge in a stream immediately before entering the mold, and finally to (c) adding the alloy into a portion of the gating system within the mold.

The earliest use of adding magnesium alloy to a portion of the gating system in the mold was developed particularly with respect to inoculation, a form of gray iron and nodular iron conditioning which not only heralded the way but proved that total nodularization can be carried out within the mold. All of the in-the-mold techniques have possessed one common characteristic, namely: the magnesium alloy has been introduced in a particulate or powdered form. The particulate alloy was (1) introduced in measured scoops poured into a reaction chamber defined in a sand mold, or (2) the alloy was premolded in particulate form within a foam suspension defining the gating system, or (3) a pre-compacted or extruded shape of particulate magnesium alloy was placed in the gating system contacting only one supporting surface. The latter has only been conceptually brought forth; it has not been used in a practical manner to date.

This progression of technology has resulted in a more matched use of magnesium with the needs of the specific casting, it has eliminated fading effects associated with the use of the alloy, eliminated flare and other environmental problems, and aided in reducing costs. Nonetheless, there still remains the likelihood of (a) defects in the casting resulting from undissolved or nonuniformly mixed particulate nodularizing agent which has floated or been carried into the casting cavity, (b) variable segregation of the alloy or a variable solubility rate causing a chemical and metallurgical variation in the casting, (c) unnecessary waste (low yield) resulting from increasing the volume of the gating system to accommodate the particulate matter, (d) the inability to closely target the minimum amount of magnesium alloy to obtain complete or partial nodularization, (e) inclusions in the casting resulting from the greater surface oxidation of the selected nodularizing agent used in particulate form and/or from contaminants in the nodularizing agent and (f) handling problems associated with particulate nodularizing agents.

To achieve increased economy and greater control of the quality of nodularization resulting from introducing the alloy in the mold, some mechanism is needed to overcome the deficiencies above cited which are associated with the particulate form of nodularizing agent.

SUMMARY OF THE INVENTION

The primary object of this invention is to provide a method of making nodular cast iron with improved economy and improved quality of the nodularized casting.

Another object of this invention is to provide a method of making nodular iron castings which, through consistent control and uniformity of solution rate of the nodularizing agent, gives a controlled degree of nodularization and homogeneity to the final casting.

Particular method features pursuant to the above objects is the use of a dense unitized block of nondularizing agent, substantially devoid of alloy oxides particularly within the interior of said block (or mass of nodularizing agent), and having a shape and cross-section substantially identical to the cross-section of a mating recess in the gating system of the mold whereby a substantially uniform dissolution of the block is continuously achieved as the molten charge of cast iron flows across said block.

With respect to achieving greater economy, this invention specifically provides for a greater number of casting patterns within a single given mold dimension, reduces the quantity of magnesium alloy utilized, particularly through improved alloy recovery, reduces the total volume of the gating system thereby increasing the yield of the process, and permits the improved process to be used with vertically parted molds thereby introducing the advantages of in-the-mold nodularization to such molding techniques and reduces handling problems associated with particulate nodularizing alloy such as weighing, addition, and when necessary removal from the mold cavity.

With respect to an improvement in quality, the invention herein specifically provides for: prevention of undissolved nodularizing agent particles in the mold cavity, prevention of size segregation normally associated with the particulate alloy, prevention of a variable solution rate thereby eliminating inhomogeneity in the resulting casting, less oxidized surface area and/or less chance for contamination for the nodularizing agent employed with this process thereby resulting in reduced defects in the final casting, and eliminating defects that might result from alloy particles being dislodged from the reaction recess while blowing off the parting surfaces of the mold prior to being mated for casting or from being spilled into a casting cavity during dispensing of the particulate form of nodularizing alloy.

DETAILED DESCRIPTION

Figure 1:
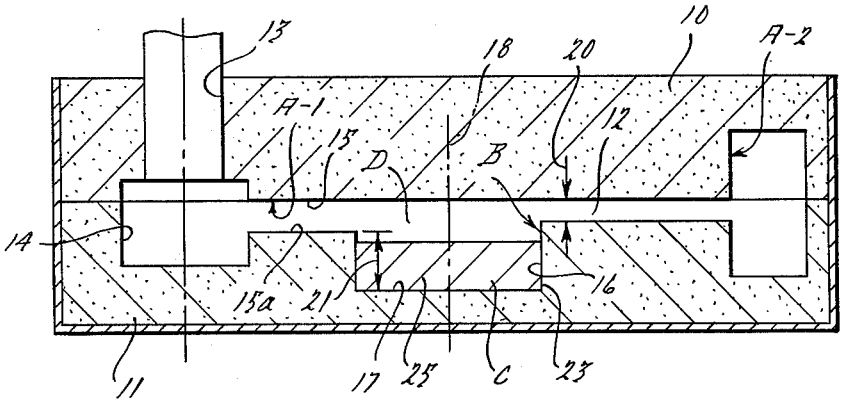
FIGS. 1 and 2 represent respectively a central elevational view and a plan view of a green sand mold apparatus embodying the principles of this invention.
Figure 2:
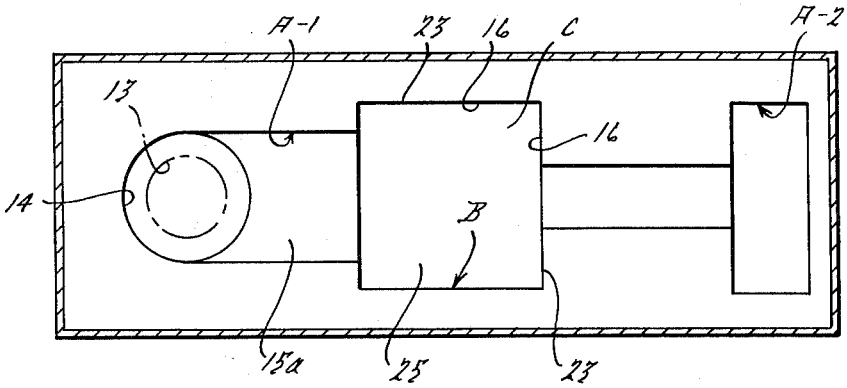

FIGS. 1–2 depict one form of molding apparatus within which the invention is embodied. The molding apparatus comprises essentially a mold system A preferably formed of bonded sand, containing a gating system A-1 and an internal cavity A-2 of predetermined shape for defining the ultimate useable casting. A pocket or a recess B is defined to receive the nodularizing agent in a unique configuration and manner; a unitary block of nodularizing agent C is employed to fit snugly within said recess to present substantially a unitary and consistent interface surface exposed to a molten charge flowing through the gating system in zone D and passing along said solid block.

The mold system A comprises particularly a cope 10 and a drag 11 meeting along a parting surface 12 which extends horizontally through first walls defining the cavity A-2. The gating system employs second walls defining a conventional downsprue 13 with a basin 14, the basin having a cross-section greater than the downsprue or horizontal runner 15 (the horizontal runner 15 leads to the molding cavity A-2). The gating system may contain risers, skimmers, dams and other devices which are not shown here.

The recess B has second walls comprised of side walls 16 and bottom wall 17 which define a space set into and along the lower wall 15*a* of the horizontal runner. The cross-sectional area of recess B as viewed generally parallel to surface 15*a* (or transverse to line 18 which is normal to the extent of the surface 15*a*) is substantially the same throughout each elevation of the block. The side walls 16 may be given a taper (such as 5–15% to reduce the cross-sectional area at the bottom of the recess and thus accommodate an increase in dwell time of the trailing end of the charge flow which occurs particularly with gating systems experiencing a large variation in ferrostatic pressure during the entire pour cycle.

In order to achieve minimum 80% nodularity in the casting, the exact volume of recess B must be obtained substantially empirically, but as a rough rule it is designed in conformity with the following relationship:

$$V(\text{in}3) = K \times W/M$$

where $K$ = constant
$W$ = weight of the metal poured into the mold
$M$ = % Mg in MgFeSi alloy
$K$ = 0.265 for average casting sections ¼ inch to 1.5 inch
$K$ = 0.275 for average casting sections 1.5 inch to 4 inches The weight is that of the molten cast iron charge. This relationship is significant since it demonstrates that the reduced volume required with this invention is opposed to that required for the prior art; the volume relationship is typically at least twice as much to accommodate particulate material and maintain an equivalent solution rate with all other factors being equal. In many applications, the block form will occupy about 80% of the volume of the recess wherein the powder form occupies typically a maximum of 55%. The height 20 of the runner 15 can be as little as 0.25 inch, but the height 21 of the recess should be no greater than 10 times the dimension at 20. This dimensional limitation cannot be achieved when using a particulate agent.

The nodularizing agent is formed as an impervious mass of block C snugly fitting into recess B; side walls 23 and bottom wall 24 repectively mate with side walls 16 and bottom wall 17 of the recess. The mating relationship is such that molten cast iron cannot conveniently flow along the sides of the block other than the upper exposed surface 25. Some penetration may be experienced in some applications along the sides of the block due to small tolerances, but this quickly freezes during conditioning and the flow avoids this area. The upper surface is configured to be substantially parallel and slightly below the surface 15*a* of the runner (such as 0.25 inch or less inches; with particulate material the distance 49 must be at least 0.75 inch). Thus, molten cast iron will be encouraged to intimately contact surface 25 of the block since it will drop and undergo a dip in its flow across the block; this will prevent molten metal from gliding swiftly in a streamlined manner with large portions thereof never contacting the block. Both because the block is solid and the flow is drawn down to the block out of the normal runner flow, there will be little or no tendency for dragging particles of undissolved agent into the casting cavity. The agent will not move until reacted with the flow; this is also assured by reducing 5–10% the cross-sectional area of the runner exiting from the recess in comparison to the cross-sectional area of the runner leading to the recess.

The block is preferably constituted of magnesium ferrosilicon alloy such as is conventionally used in the production of nodular iron, but other agents may be selected from the group consisting of cerium, yttrium, other rare earths, calcium, and their alloys and such selected agent may be combined in a desired concentration with other elements compatible with cast iron to form a binary or more complex conditioning alloy. Examples of other elements are iron, silicon, carbon, nickel, etc.

The nodularizing agent is preferably formed as a substantially homogeneous substance such as by casting into chill molds. For making magnesium ferrosilicon, a quantity of quartzite (silica) is reduced and melted in the presence of carbon and iron to a molten ferrosilicon alloy in an electric furnace, to which is added magnesium (5–15%) and generally rare earth metals and calcium. The molten nodularizing alloy is poured into closed chill molds to define modules or precisely measured blocks with predetermined dimensions. The interior of each block will be substantially free of oxides; and will generally have far less total MgO/pound of alloy as a result of far less surface area per pound than particulate alloy forms. This is important because one of the advantages herein is an increase in solution rate and greater economy of alloy use due to more free magnesium available within the alloy. Thus, less contact time of the molten charge is required to pick up the required amount of magnesium to facilitate nodularization. One possible explanation for this is concerned with a physical barrier. If MgO were present, such as about each particle of a powdered agent (whether in loose or compacted form), this MgO does not take part in the nodularization of cast iron but contaminates the iron charge as a slag or dross impurity. This is generally prevented from entering the casting cavity by enlarging the runner and the gating volume so as to allow it to float out of the metal. Another possible explanation for this may be grounded in heat transfer. The heat of the molten cast iron must first be used to remove the outer shell of refractory-like oxide before heat can operate on the agent itself. This increase in heat will require that the molten runner flow be 2–3 inches higher for a typical casting application and will limit mold design, reduce casting yield, and increase the possibility of a nonuniform nodularized casting. Variations in surface oxidation during crushing, handling and storage of particulate nodularizing alloy forms increase this problem.

With these two factors, the total volume of the runner or gating system can now be made smaller; the risers, downsprues, and runners can be reduced as much as 25% in some cases (the recess or reaction chamber can be reduced by as much as 60%), thus rendering a significant increase in yield.

The block, since it is made as a direct chill casting has minimum alloy segregation and results in a uniformly conditioned molten iron. Alloy segregation may occur in two ways with respect to powdered agents: (a) when made as a powder, such as 6 × 20 mesh, the finer particles will settle out toward the bottom of the bulk shipment during transportion to the site of use; (b) all finer particles will, immediately on crushing, form an MgO coating which is an impurity and may constitute a significant volume of the powder. The latter shows up as slag in the system and, if excessive, will move to the final casting as a defect. Only by reducing the exposed surface area of the agent can this be improved.

Figure 3:
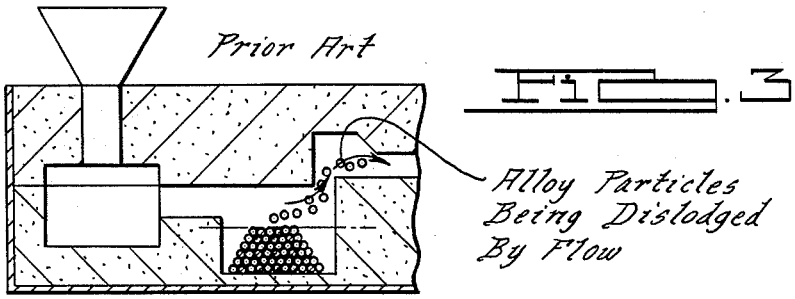
FIG. 3 is a schematic illustration of a gating system employing the type of nodularizing agent typically used by the prior art and depicting one problem associated with such process.

The solid character of the agent is advantageous also because it allows a consistently accurate predetermined weight of agent, free from operator discretion or errors of calculation. The block eliminates migration of the agent into the casting cavity in an undissolved form; the latter may occur with a powdered or granular agent as drag-through by the molten metal flow (see FIG. 3) or as blow-out (or off) when the open drag is cleaned off by air jets prior to mold closure while the agent is in place. With respect to the latter, high air flows can now be used during the blow-off step without risk of contamination or loss of agent. Moreover, the typical alloy addition operation can now be manually handled by one or two men as opposed to two or three men using the techniques of the prior art. Automation of the addition system is also condsiderably simplified wit the block material.

The design of the cross-sectional area of the block is critical to achieving a uniform solution rate, the latter being unattainable by the prior art. The cross-sectional area determines the exposed interface with the molten cast iron since the sides and bottom and interior of the block are not exposed to molten iron flow. Thus, as the each successive section of the block dissolves, a new cross-section becomes progressively exposed. This interface area should be substantially constant throughout the entire period of conditioning, although it has been found necessary to deviate somewhat when using a casting technique experiencing a wide variation in ferrostatic pressure head and consequently molten iron flow rate over the block during conditioning. The former can be achieved by making the block with a uniform cross-section throughout, the latter can be achieved by incorporating a taper into the side walls of the block so that the bottom cross-sectional area will be less. The taper can be about 5°–15°. A wide variation of metal flow rate can occur in vertical shell mold casting techniques where a tall object is to be cast. The weight of the molten iron in the filled cavity will counter the weight of the iron in gating system causing a decrease in pour rate near the trailing end of conditioning which in turn increases the molten iron dwell time and thus the amount of heat being transferred to the agent in the recess. By reducing the exposed interface area at the trailing end of the pour commensurate with the change in molten iron flow rate, a constant solution rate can be assured.

Although the block is preferably illustrated as recessed in a wall of the horizontal runner with a mold system, it can be recessed in a wall of the runner system used as an exterior stream treatment device for conditioning the molten iron prior to it being introduced to the mold.

Figure 4:
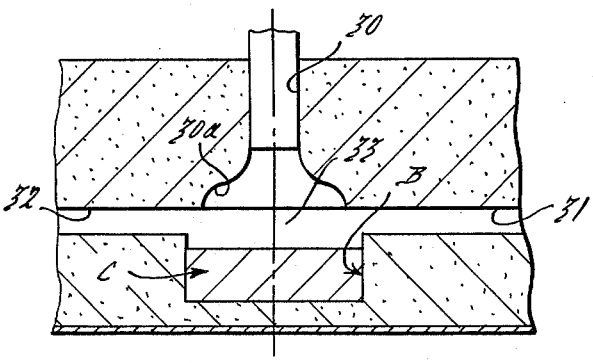
FIGS. 4 and 5 are schematic views similar to FIGS. 1 and 2, but with respect to a different type of gating system while still embodying the principles of this invention.
Figure 5:
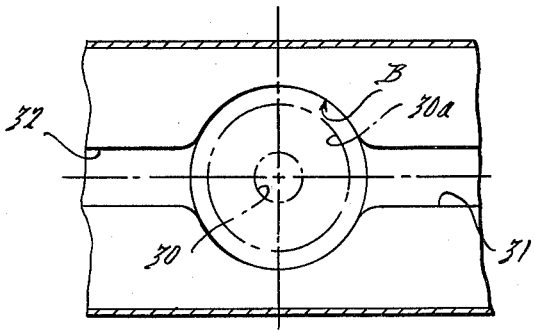

As shown in FIGS. 4 and 5, the invention herein can be utilized in other gating system arrangements such as the extreme situation illustrated here. This situation is normally recommended for low magnesium containing nodularizing alloys. The recess B (here annular) is located directly beneath the downsprue 30 which terminates in an annular mouth 30*a* simultaneously acting as a form of basin. Runners 31 and 32 extend oppositely from the zone 33 beneath the downsprue. Again the block C intimately contacts the sides and bottom of the recess B.

Actual plant trials using this invention have demonstrated that the % nodularity of the final casting will be as good as any commercial method now used, but will show important improvements in homogeneity and total absence of a major reduction in chill (carbide forming) tendency. The % residual Magnesium can now be consistently regulated to be in any selected range to achieve a desired degree of nodularity. For instance, the highly dense block of alloy typically permits reliable nodularity of at least 80% or more in the final casting with only 0.02–0.03% residual magnesium; the latter is in direct contrast to the prior art which, to obtain reliable nodularity of 80% or more in the final casting using a particulate or granular agent, typically must have 0.030–0.06% residual magnesium.

A comprehensive method for producing nodularized graphitic iron castings according to this invention, comprises:

a. providing a discrete block of nodularizing agent produced by reducing the silica with carbon in which is typically dissolved iron in the range of 30–50%, magnesium in the range of 5–15%, aluminum 0.5–1.5% calcium 0.5–3.0%, and cerium 0.3–1.5%, said alloy solution being processed in closed vessels and poured into closed chill molds to form said blocks or by other suitable means;

b. providing a molten cast iron charge having a composition consisting of carbon 2.5–4.0%, sulphur 0.005–0.02%, silicon 1.5–3.5%, manganese 0–1.5%, phosphorus 0.05–0.1% the normal levels of other residual elements typically encountered in nodular iron production and the remainder iron (other standard nodular iron base metal compositions will work equally well). The charge may be iron that is called grey (that which will solidify with flake graphite) or may be partly nodularized (that which will solidify with vermicular graphite);

c. preparing at least a two-part mold system having first walls in one or both of said parts defining one or more mold cavities, second walls in one or both of said parts defining a gating system in communication with said cavity, and third walls interrupting said second walls to define one or more recesses on or off the parting surface of said mold system, said third walls providing a substantially uniform cross-sectional area taken in a direction generally parallel to the portion of said second walls that is interrupted;

d. inserting one of said blocks into each of said recesses in a manner to substantially occupy the interior of each of said recesses, said block having an exterior surface mating with the bottom and side walls of said recess to thereby present only an exposed top surface, and e. introduction of a predetermined quantity of said molten charge into said mold system generally at a pour rate of 10–25 lbs./sec., the upper exposed surface of said block and pour rate being regulated during charge introduction to produce a desired % of graphite nodularity normally between 40–100% in the final solidified casting.

The block may be arranged in the gating system to achieve zoned graphite structures with a predetermined variance of nodularity in the final casting. This may be achieved by utilizing a shaped block (for example tapered) to vary the % magnesium in the iron going to various portions of the final casting or by using multiple ingates and chambers.

A particularly significant advantage of this invention is the ability to accurately program a desired uniform percentage of nodularity throughout the final casting, such as between 30–100%. In this manner, certain less critical applications may be fabricated with significant savings in cost. A preferred method improvement for carrying out conditioning to achieve difficient levels of nodularity, comprises:

a. recessing an impervious mass of nodularizing agent in and along a wall of a gating system leading to a mold cavity, said mass and recess being related to provide for a substantially uniform dissolution rate of said mass, said mass being substantially devoid of impurities (such as oxides) therein and having a homogeneous alloy of magnesium and other conditioning agents, the mass is arranged to present a substantially constant but predetermined interface surface area and contains a predetermined quantity of magnesium to render a predetermined degree of nodularity in the final casting according to the relationship $$K \times [\text{interface area (in}^2\text{)/pouring rate No./sec.}] [\%\,\text{Mg}] = \%\ \text{nodularity}$$

where $K$ is an imperical factor typically in the range of 25–30 for section thicknesses from 0.25–1 inch and 20–22 for 1–3 inch thick sections and %Mg is the % in the conditioning alloy, and b. introducing an effective amount of molten grey cast iron into said gating system allowing said molten charge to flow across said interface surface to progressively dissolve said mass.

The mass may preferably be constituted of magnesium ferrosilicon having a magnesium concentration generally between 5–15%. The above relationship may also be used to obtain an equivalent % nodularity by maintaining the pour rate constant, while increasing the magnesium concentration and reducing the interface area proportionately.

Figure 6:
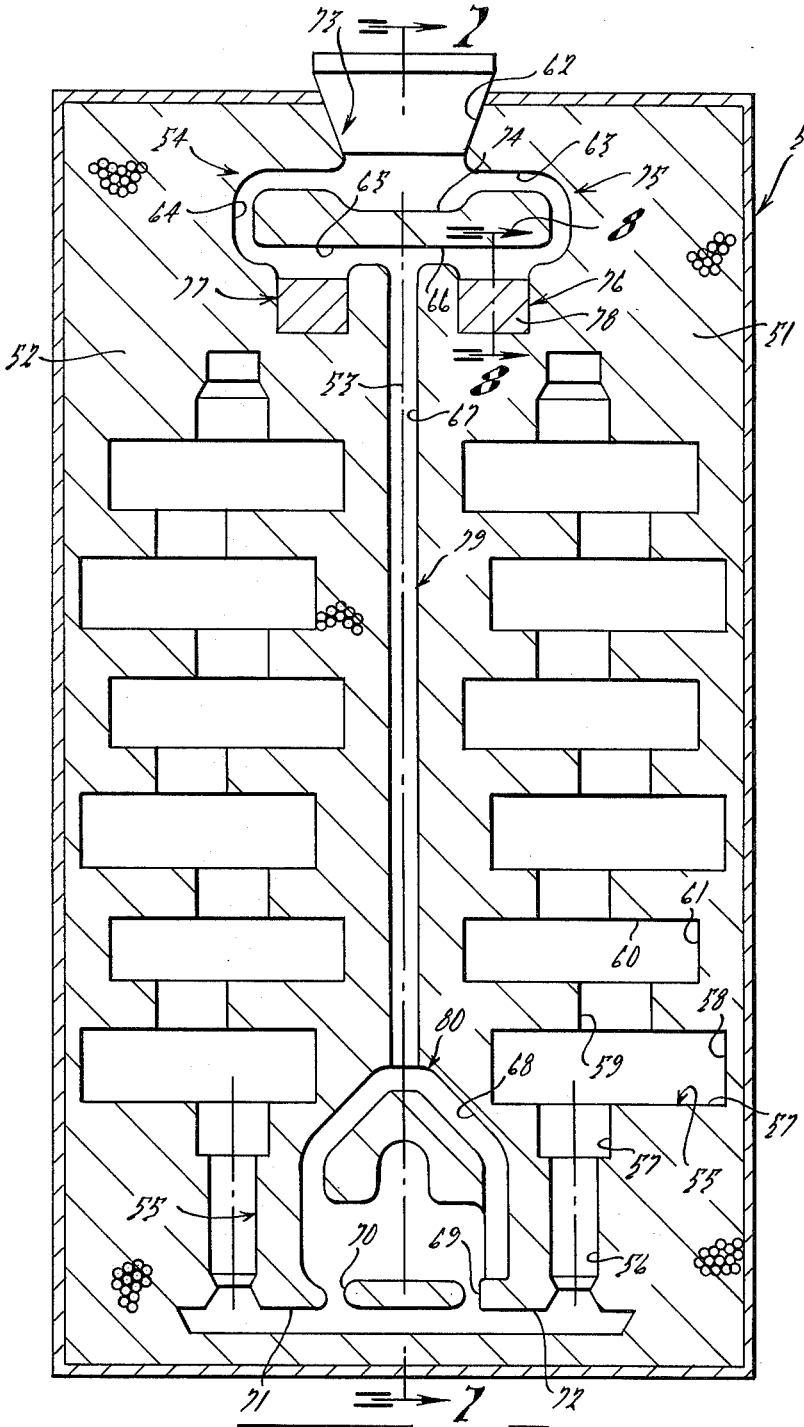
FIGS. 6–8 represent respectively a central sectional elevational view, another sectional elevational view taken at right angles to the first view, and a section view of a portion of the gating system of the mold, said views being associated with a shell molding apparatus incorporating the features of this invention.
Figure 7:
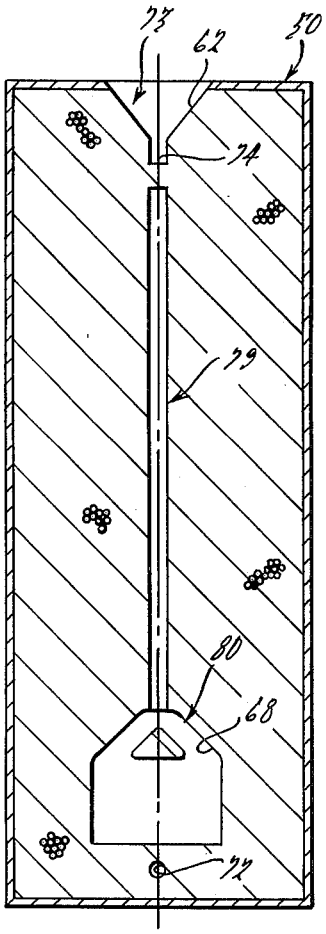
Figure 8:
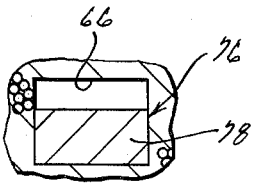

Turning now to FIGS. 6–8, the mold system 50 is comprised of at least two parts 51 and 52 mated along vertical surface which is the section plane along which FIG. 6 is viewed; a two part shell mold which is formed in a conventional manner by shell molding techniques to define a gating system 54 and mold cavities 55. The shell mold of the gating system and mold cavities is backed up by typical steel shot (not shown) provide an appropriate mold closing. Accordingly, first walls 56–61 define a mold cavity, here typically shown to be for a crankshaft of an automotive engine. The cavity is in communication with the gating system 54 having second walls 62–72 which are arranged to receive the molten charge at a pouring cup 73 and convey it to the cavities 55. The second walls are particularly comprised of the ingate or pouring cup 73, a basin 74, a split circulatory path 75 leading to a pair of interface chambers 76 and 77 in each of which a solid block 78 of nodularizing agent is disposed; a central downsprue 79 connects path 75 to a swirl chamber 80 having dual horizontal runners exiting therefrom and leading respectively to each of the mold cavities. The mold cavities are fed from the bottom as shown in FIG. 6.

In spite of the fact that the mold is parted vertically, addition of the agent is possible when in solid block form and fitting snugly the recesses 76 and 77. This is true whether the recesses are on the parting surface, as shown in FIG. 6 or off. Increased reactivity of the agent results from essentially two characteristics, one of which is the elimination of porosity or the increased internal surface area of the agent associated with a particulated powder form. The heat of the molten charge is spread and dissipated over a larger surface area with particulate agents, thereby lowering the temperature somewhat of the nodularizing agent at the immediate interface surface. The other is the existence of oxide disposed about the outer surface of each particle of the powder form.

The manner in which the solid block of nodularizing agent is configured and arranged within the gating system is important. The walls defining the recess, here referred to as third walls, are arranged to provide a uniform cross-section throughout its depth (its depth being taken in a direction normal to the adjacent surface of the runner system within which the recess is located). Thus, if the block of nodularizing agent is made in close conformity with such cross-section, so that it will fit snugly along the sides as well as bottom wall of the recess, the block will present only a unitary upper surface to the molten charge flowing thereacross. Thus, as the nodularizing agent is progressively dissolved incrementally, the same amount of exposed surface of nodularizing agent will be presented throughout each step of the dissolution.

We claim:

1. A method of conditioning a charge of molten cast iron which would normally solidify with a flake graphite structure immediately before casting to produce modified shape graphite cast iron castings, wherein the improvement consists of (a) recessing an impervious mass of nodularizing agent in and along a wall of gating runner system leading to a mold cavity so that the mass presents substantially a constant reaction interface surface throughout conditioning, and (b) introducing an effective amount of molten grey cast iron charge into said gating system allowing said molten charge to flow across said interface surface to progressively and uniformly dissolve said mass.

2. The method as in claim 1, in which said mass is formed as a unitary block, the reaction interface surface being substantially constant except to compensate for increased dwell time of the molten metal in the recess where the casting technique experiences a wide variation in the ferrostatic pressure head.

3. The method as in claim 1, in which said mass is substantially interiorly free of magnesium oxide.

4. The method as in claim 1, in which said mass is comprised of a solid magnesium alloy to effect spheroidal graphite cast iron.

5. The method as in claim 4, in which said mass is comprised of magnesium ferrosilicon.

6. The method as in claim 1, in which said mass is formed as a unitary block and is snugly recessed within a previously defined chamber of a mold system.

7. The method as in claim 1, in which said mass is recessed within a portion of a conduit forming part of the metal flow system exterior of the mold system.

8. The resulting product of practicing the method of claim 1 and in which the residual magnesium is in the range of 0.02–0.03% by weight of the casting and the product contains 80% or more nodularity.

9. The method as in claim 1, in which said mass has a shape deviating from said recess to achieve a predetermined percentage magnesium in the resulting solidified iron.

10. The method as in claim 1, in which said mass is recessed so as to allow a small tapered gap between said block and side wall.

11. The method as in claim 1, in which said mass is proportioned to the amount of molten metal reacting therewith to divide a percentage nodularity in the final casting which is less than 50%, but greater than 30%.

12. The method as in claim 1, in which said system has multiple ingates and a recess associated with each ingate, one of said masses being located in each recess and having a composition and shape effective to provide a percent nodularity in the molten iron passing through one of said recesses which is independent from the other.

13. A method of conditioning a charge of molten grey cast iron immediately before casting to produce a predetermined degree of spheroidal graphite in the casting made therefrom, the improvement comprising:

a. recessing an impervious mass of nodularizing agent in and along a wall of a gating system leading to a mold cavity, said mass and recess being related to provide for a substantially uniform dissolution rate of said mass, said mass being substantially devoid of impurities therein and having a homogeneous alloy of magnesium and other conditioning agents, the mass is arranged to present a substantially constant but predetermined interface surface area and contains a predetermined quantity of magnesium to render a predetermined degree of nodularity in the final casting according to the relationship $$K \times [\text{interface area (in}^2\text{)/pouring rate No./sec.}] [\%\text{Mg}] = \%\ \text{nodularity}$$

where $K$ is an imperical factor typically in the range of 25–30 for section thicknesses from 0.25 to 1 inch and 20–22 for 1–3 inch thick sections and % Mg is the magnesium concentration in the conditioning alloy, and b. introducing an effective amount of molten grey cast iron into said gating system allowing said molten charge to flow across said interface surface to progressively dissolve said mass.

14. The method as in claim 13, in which said mass has less than 0.20 impurities.

15. The method as in claim 13, in which said magnesium constitutes between 5–15% of said mass.

16. The method as in claim 13, in which an equivalent % nodularity is achieved by maintaining the pour rate constant, while increasing the magnesium concentration and reducing the interface area proportionately.

17. The method as in claim 13, in which the mass is arranged with a substantially uniform cross-sectional area except for a slight taper to reduce the area at the trailing end of the pour to compensate for increased temperature conditions at the interface facilitating greater solubility.

18. A method of producing nodularized graphitic iron castings, comprising:

a. providing a discrete block of nodularizing agent by reducing silica to silicon in which is dissolved iron in the range of 20–50%, magnesium in the range of 5–15%, aluminum 0.5–1.5%, calcium 0.3–2.0% and cerium 0.3–1.5%, said alloy solution being processed in treatment vessels and poured into closed molds to form said blocks, b. providing a molten cast iron charge generally having a composition consisting of carbon 2.5–4.0%, sulphur 0.005–0.02%, silicon 1.5–3.5%, manganese 0–1.5%, phosphorus 0.02–0.1% and the remainder iron plus other conventional ductile iron alloys and residuals, c. preparing at least a two-part mold system having first walls in one or both of said parts defining one or more mold cavities, second walls in one or both of said parts defining a gating system in communication with said cavity, and third walls interrupting said second walls to define one or more recesses on or off the parting surface of said mold system, said third walls providing a substantially uniform cross-sectional area taken in a direction generally parallel to the portion of said second walls that is interrupted, d. inserting one of said blocks into each of said recesses in a manner to substantially occupy the interior of each of said recesses, said block having an exterior surface mating with the bottom and side walls of said recess to thereby present only an exposed top surface, and e. introduction of a predetermined quantity of said molten charge into said mold system at a pour rate generally 10–25 lbs./sec., the upper exposed surface of said block and pour rate being regulated during charge introduction to produce a desired % of graphite nodularity between 30–100 in the final solidified casting.

19. A molding apparatus for use in making nodular cast iron within a mold system, the apparatus comprising:

a. at least a two part refractory mold body, said body having first walls on one or both of said parts defining a molding cavity, said body having second walls on one or both of said parts defining a gating system in communication with said cavity, said body also having third walls defining one or more recesses in said second walls on or off the parting surface between said parts, said recesses having a bottom wall, side walls and an open top, said third walls providing a uniform cross-section taken in a direction normal to that portion of said second walls within which said recesses are deposed, and b. an impervious solid mass of nodularizing agent disposed in and substantially occupying the interior of each of said recesses, said mass having an exterior surface mating with the bottom and side walls of the recess thereby presenting only an exposed top surface generally parallel to the orientation of said second wall within which said recess is disposed.

20. The apparatus as in claim 19 in which said parting surface is vertically oriented.

21. A molding apparatus for use in making nodular cast iron within a mold system, the apparatus comprising:

a. at least a two part mold body comprised substantially of bonded sand, the mating surface of the parts of said body having first walls on one or both of said mold parts defining a mold cavity, said body also having second walls on only one of said mold parts defining a gating system in communication with said cavity, b. third walls defining a recess in said second walls of said one part, said third walls having a bottom wall, sidewalls, and an open top, said third walls being arranged to provide a uniform cross-section for said recess taken in a direction normal to the surface of the gating system within which said recess is disposed, c. a unitary solid block of nodularizing agent disposed in and substantially occupying the interior of said recess, said block having an exterior surface mating with the bottom and side walls of said recess and thereby being arranged to present an exposed top surface of said block to molten metal only flowing in a direction which is generally parallel with the orientation of the top surface.

22. The molding apparatus as in claim 21, in which the transverse height of said gating system at the location within which said recess is disposed, is greater than 0.5 inches but less than ½ the height of said recess.

* * * * *